US007714553B2

(12) United States Patent
Lou

(10) Patent No.: US 7,714,553 B2
(45) Date of Patent: May 11, 2010

(54) VOLTAGE REGULATOR HAVING FAST RESPONSE TO ABRUPT LOAD TRANSIENTS

(75) Inventor: Chih-Hong Lou, Yilan County (TW)

(73) Assignee: Mediatek Inc., Hsin-Chu (TW)

( * ) Notice: Subject to any disclaimer, the term of this patent is extended or adjusted under 35 U.S.C. 154(b) by 245 days.

(21) Appl. No.: 12/034,674

(22) Filed: Feb. 21, 2008

(65) Prior Publication Data

US 2009/0212753 A1 Aug. 27, 2009

(51) Int. Cl.
*G05F 1/571* (2006.01)
*G05F 1/565* (2006.01)

(52) U.S. Cl. ..... 323/276; 323/268; 323/274

(58) Field of Classification Search ..... 323/268, 323/269, 270, 273, 274, 275, 276; 361/90, 361/91.1, 92

See application file for complete search history.

(56) References Cited

U.S. PATENT DOCUMENTS

| | | | | |
|---|---|---|---|---|
| 5,764,460 | A * | 6/1998 | Perillo et al. | 361/18 |
| 6,806,690 | B2 * | 10/2004 | Xi | 323/273 |
| 6,909,265 | B2 * | 6/2005 | Tang | 323/274 |
| 6,975,494 | B2 * | 12/2005 | Tang et al. | 361/64 |
| 7,199,565 | B1 * | 4/2007 | Demolli | 323/273 |
| 7,221,213 | B2 * | 5/2007 | Lee et al. | 327/541 |
| 7,362,079 | B1 * | 4/2008 | Maheedhar et al. | 323/269 |
| 7,554,309 | B2 * | 6/2009 | Carpenter et al. | 323/282 |
| 7,570,035 | B2 * | 8/2009 | Kleveland | 323/276 |

* cited by examiner

*Primary Examiner*—Gary L Laxton
(74) *Attorney, Agent, or Firm*—Thomas, Kayden, Horstemeyer & Risley

(57) ABSTRACT

A voltage regulator includes an undervoltage detector having a charge transistor smaller than an output transistor of the voltage regulator, providing a detection path for fast response, compensating undervoltage without large control current when loading changes from light to heavy.

18 Claims, 5 Drawing Sheets

VOLTAGE REGULATOR HAVING FAST RESPONSE TO ABRUPT LOAD TRANSIENTS

BACKGROUND OF THE INVENTION

1. Field of the Invention

The invention relates to a voltage regulator, and in particular to a voltage regulator having fast response to abrupt load transients.

2. Description of the Related Art

FIG. 1 shows a voltage regulator as disclosed in U.S. Pat. No. 6,201,375. The voltage regulator 100 comprises an error amplifier 102, an output transistor (power NMOS transistor) 104, a feedback circuit comprising resistors R1 and R2, a comparator 106, a transistor (NMOS transistor) 108 and an output capacitor CL. The voltage source 105 is the input offset voltage $V_{OFS}$ of the comparator 106. The comparator 106 and the NMOS transistor 108 form a local load transient suppression loop which specially deals with a load condition while the voltage regulator 100 suffers from heavy load to light load. When loading of the voltage regulator 100 changes from heavy to light, the output regulated voltage $V_{OUT}$ suffers an abrupt rise (or overvoltage). Hence, the feedback voltage $V_{FB}$ is also increased. When the feedback voltage $V_{FB}$ exceeds the sum of the reference voltage $V_{REF}$ and the input offset voltage $V_{OFS}$, the comparator 106 turns on the NMOS transistor 108 to sink currents, thereby reducing the overvoltage of the output regulated voltage $V_{OUT}$. More particularly, when the output voltage $V_{OUT}$ exceeds the reference voltage $V_{REF}$ by a voltage $$V_{OFS} \times \frac{R_1 + R_2}{R_1},$$

the load transient suppression loop is activated to control the overvoltage of the output regulated voltage $V_{OUT}$.

Generally, electronic systems adopting a voltage regulator are more sensitive to undervoltage of the regulated output voltage than overvoltage of the regulated output voltage. The voltage regulator suffers undervoltage of its output regulated voltage when its loading changes from light to heavy. For example, the output regulated output $V_{OUT}$ of the voltage regulator 100 is supplied to an electronic system (not shown in FIG. 1). When the electronic system is in a power-off or standby state, i.e. with a light load, the output transistor 104 outputs a considerably small current. When the electronic system switches to a power-on state, i.e. with a heavy load, the voltage regulator 100 must supply large current to the electronic system. However, the output transistor 104 cannot supply current suddenly to satisfy the large current requirement, and thus the voltage regulator 100 cannot respond rapidly enough to compensate the output undervoltage of the output regulated voltage $V_{OUT}$.

Generally, in order to increase current supplied from the output transistor 104, the gate voltage of the output transistor 104 should be pulled up by the feedback loop path of the voltage regulator 100, through the feedback circuit (R1 and R2), the error amplifier 102 and the output transistor 104. Unfortunately, transient response of the feedback loop path is very slow due to compensation stability. In addition, the output transistor 104 (power NMOS transistor) is often large and thus has a large gate capacitance, resulting in speed limitation when charging the gate voltage of the output transistor 104. An added buffer stage with increased bias current may speed the response of the output transistor 104, but current consumption of the voltage regulator 100 is then increased and feedback loop delay still remains.

BRIEF SUMMARY OF INVENTION

An object of the invention is to provide a voltage regulator with an undervoltage detector to achieve faster undervoltage compensation.

Another object of the invention is to provide a voltage regulator further having an overvoltage detector to achieve faster overvoltage compensation.

The invention provides an exemplary voltage regulator which comprises an amplifier having a first input coupled to a first reference voltage, a second input coupled to a feedback signal, and an output producing a control signal; an output transistor having a control input, a first electrode coupled to an first input voltage, and a second electrode coupled to output a regulated output voltage to an output terminal; a feedback circuit coupled to the output terminal to produce the feedback signal; an undervoltage detector coupled to the first reference voltage and the feedback signal, producing a charge control signal indicating occurrence of an output undervoltage of at least a predetermined magnitude; and a charge transistor coupled between a second input voltage and the output terminal, having a control input responsive to the charge control signal to charge the output undervoltage.

The invention provides another exemplary voltage regulator comprising an amplifier having a first input coupled to a first reference voltage, a second input coupled to a feedback signal, and an output producing a control signal; an output transistor having a control input, a first electrode coupled to an first input voltage, and a second electrode coupled to output a regulated output voltage to an output terminal; a feedback circuit coupled to the output terminal to produce the feedback signal; and an overvoltage detector to rapidly discharge overvoltage of the regulated output voltage. The overvoltage detector comprises a low-pass filter coupled to the output terminal and producing a filtered signal; an overvoltage comparator having a first input coupled to the output terminal and a second input coupled to the filtered signal, producing a discharge control signal indicating occurrence of an output overvoltage of at least a predetermined magnitude; and a discharge transistor having a first electrode coupled to the output terminal, a second electrode coupled to a second reference voltage, and a control input responsive to the discharge control signal to discharge the output overvoltage.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 2:
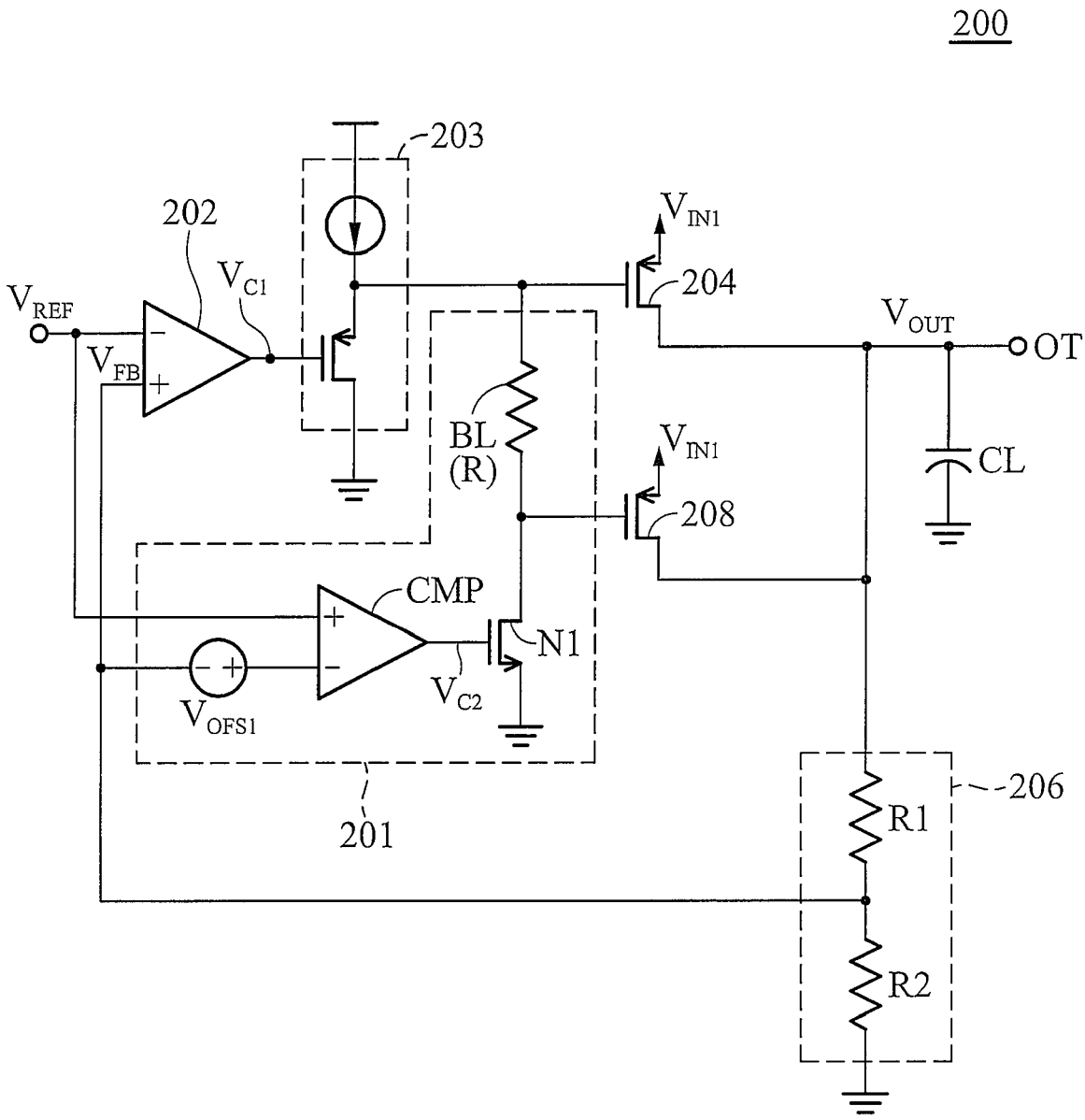
FIG. 2 shows a voltage regulator according to an embodiment of the invention.

FIG. 2 shows a voltage regulator 200 according to a first embodiment of the invention. The voltage regulator 200 comprises an amplifier (e.g. an error amplifier 202), an output transistor 204, a feedback circuit 206, a charge transistor 208, an undervoltage detector 201 and an output capacitor CL.

The error amplifier 202 receives a first reference voltage $V_{REF}$ and a feedback signal $V_{FB}$ and produces a control signal $V_{C1}$. The output transistor 204 may be a power PMOS transistor, having a control input (e.g. the gate), a first electrode (e.g. the source) coupled to a first input voltage $V_{IN1}$, and a second electrode (e.g. the drain) coupled to an output terminal OT of the voltage regulator 200 to output a regulated output voltage $V_{OUT}$. Here, the gate of the output transistor 204 is charged or discharged responsive to the control signal $V_{C1}$ through an inverter 203, which can, for example, comprise a current source and a PMOS transistor as shown in FIG. 2. The feedback circuit 206 is a voltage divider comprising resistors R1 and R2, and coupled to the output terminal OT to produce the feedback signal $V_{FB}$ by voltage division of the regulated output voltage $V_{OUT}$.

The charge transistor 208 is a PMOS transistor, having a control input (e.g. the gate), a first electrode (e.g. the source) connected to the first input voltage $V_{IN1}$ (or a different second input voltage) and a second electrode (e.g. the drain) connected to the output terminal OT. The undervoltage detector 201 comprises an undervoltage comparator CMP having a first input (+) coupled to the first reference voltage $V_{REF}$, a second input (−) coupled to the feedback signal $V_{FB}$, and an output producing a charge control signal $V_{C2}$. The undervoltage comparator CMP has an input offset voltage indicated as $V_{OFS1}$, for example, which can be provided by making the W/L (channel-width-to-channel-length) ratio of the (+) input transistor of the undervoltage comparator CMP different from the W/L ratio of the (−) input transistor thereof. Alternatively, the input offset voltage $V_{OFS1}$ can be provided by an offset voltage source coupled between the feedback signal $V_{FB}$ and the second input (−) of the undervoltage comparator CMP.

Figure 3:
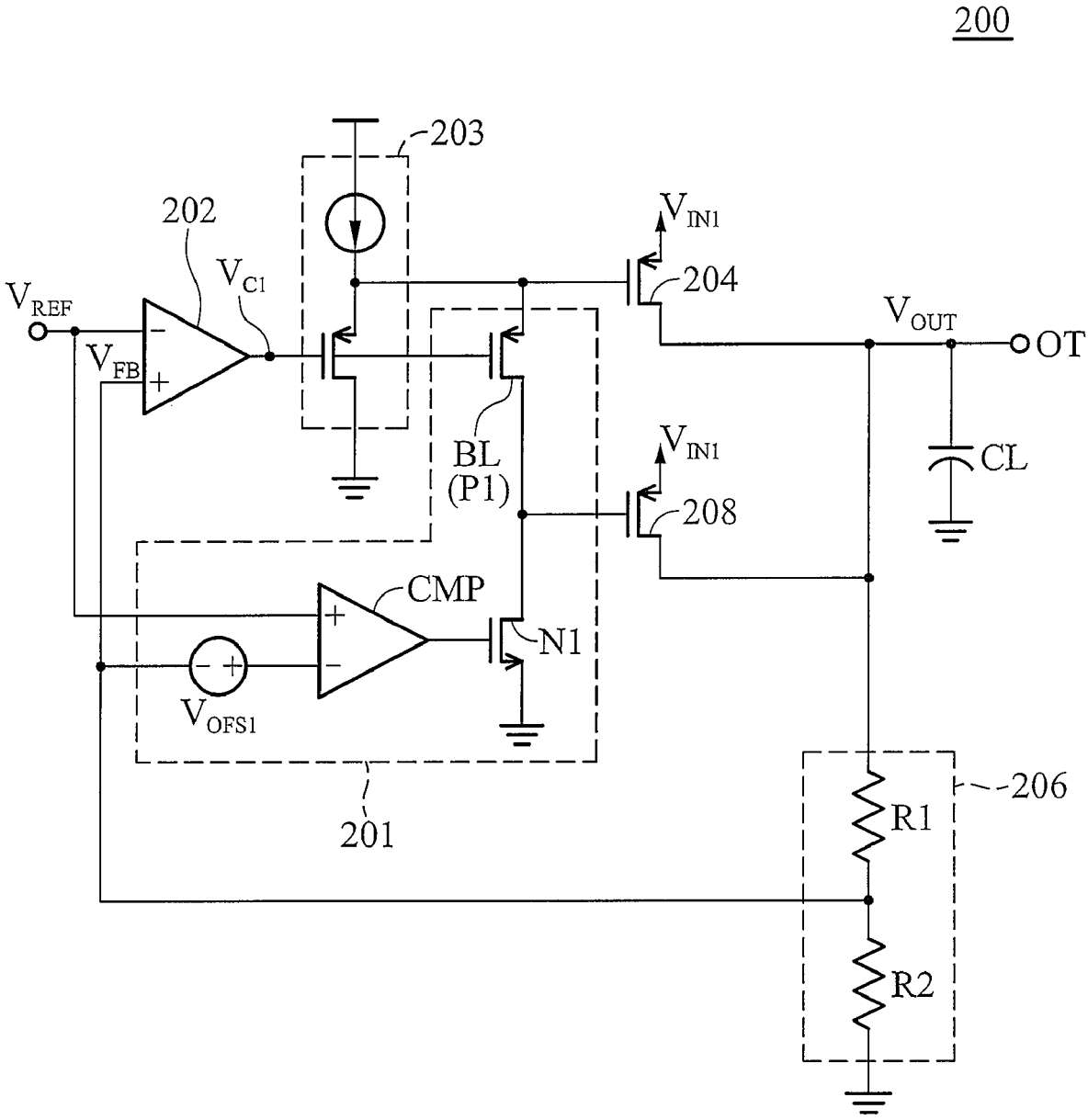
FIG. 3 shows a voltage regulator according to another embodiment of the invention.

The undervoltage detector 201 further comprises a control NMOS transistor N1 and a blocking device BL. The first control NMOS transistor N1 has a first electrode (e.g. the drain) connected to the control input of the charge transistor 208, a second electrode (e.g. the source) connected to a second reference voltage (for example a ground voltage) and a control input (e.g. the gate) connected to the charge control signal $V_{C2}$. The blocking device BL is connected between the control inputs of the output transistor 204 and the charge transistor 208. Blocking device BL, for example, can be a resistor R as shown in FIG. 2, or a PMOS transistor operating in triode region, with its gate connected to the output of the error amplifier 202 as shown in FIG. 3.

Figure 4:
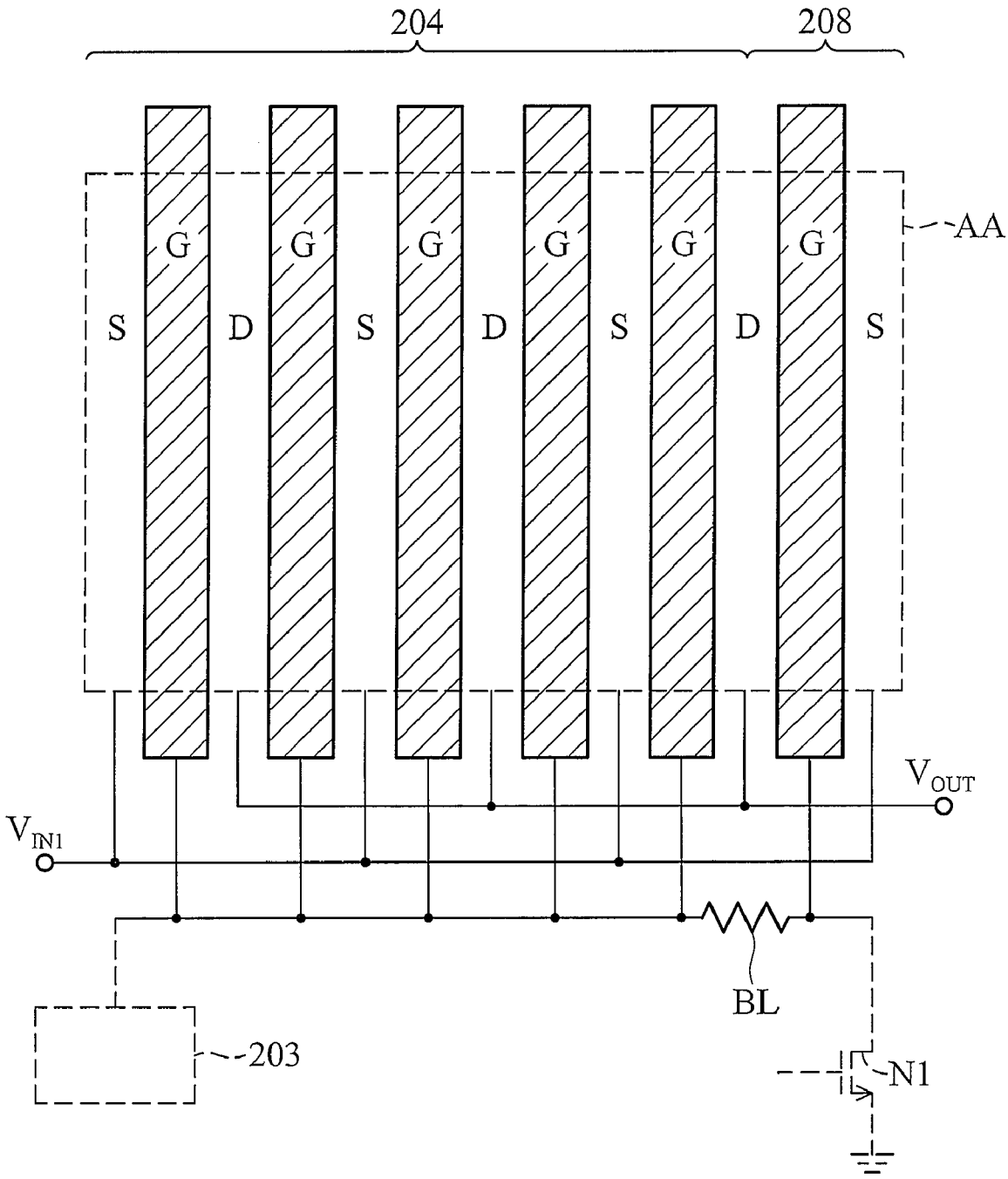
FIG. 4 shows an exemplary layout of the output PMOS transistor 204 and the charge PMOS transistor 208.

Here, the charge transistor 208 is smaller than the output transistor 204 for fast response. For low drop out (LDO) voltage regulators, dimensions of their output transistors are generally large to decrease the drain saturation voltages $V_{dsat}$. Consequently, in practice, the charge transistor 208 can be fabricated using a small part of the output transistor 204. According to the embodiment, the charge transistor 208 and the output transistor 204 can be formed on a common active area of a semiconductor substrate, with output transistor 204 having at least one drain/source region shared with the charge transistor 208. FIG. 4 shows an exemplary layout of the output PMOS transistor 204 and the charge PMOS transistor 208. Multiple gates (G) are often formed on an active area AA of a semiconductor substrate to increase dimension of a required PMOS transistor as shown in FIG. 4, which can be seen as an originally designed output transistor for the voltage regulator 200. In the example, a part of the required PMOS transistor of FIG. 4 can be used to serve as the charge transistor 208, and the remainder of the required PMOS transistor forms the output transistor 204. In addition, the gates (G), source (S) and drains (D) of the output transistor 204 and the charge transistor 208 are appropriately wired to obtain corresponding schematic circuit as depicted in FIG. 2 or FIG. 3. The dimension ratio of the output transistor 204 and the charge transistor 208 can be about N:1. FIG. 4 illustrates the example with N=5, however, the N may be greater than 10 according to obtain faster response.

Referring to FIG. 2 (or FIG. 3), when loading changes from light to heavy, the output regulated voltage $V_{OUT}$ suffers an output undervoltage of at least a predetermined magnitude, resulting in voltage drop of the feedback signal $V_{FB}$. If sum of the feedback signal (voltage) $V_{FB}$ and the input offset voltage $V_{OFS1}$ falls below the reference voltage $V_{REF}$, the undervoltage comparator CMP outputs the charge control signal $V_{C2}$ to turn on the NMOS transistor N1. The turn-on NMOS transistor N1 discharges the gate voltage of the charge transistor 208 (PMOS transistor) to low voltage level (or ground), such that the charge transistor 208 is turned on and starts to charge and compensate the output undervoltage of the output regulated voltage $V_{OUT}$.

As mentioned above, charge transistor 208 is smaller than the output transistor 204, and the gate capacitance of the charge transistor 208 is N times smaller than that of the output transistor 204. Therefore, using smaller current from the charge transistor 208, the local feedback loop path of the feedback circuit 206, the undervoltage comparator CMP, the NMOS transistor N1 and the charge transistor 204 can achieve rapid current response than the main feedback loop path of the feedback circuit 206, the error amplifier 202, the inverter 203 and the output transistor 204.

As shown in FIG. 2, the blocking device BL is a resistor R. When the NMOS transistor N1 discharges the gate of the charge transistor 208, the resistor R operates to block the output transistor 204 (i.e., large gate capacitance of the output transistor 204), ensuring fast response of the charge transistor 208. In FIG. 3, the blocking device BL is the PMOS transistor P1 with its gate coupled to the output of the error amplifier 202. The PMOS transistor P1 operates in triode region and has the same function as the resistor R in FIG. 2, while occupying less area. In other words, the blocking device BL blocks the connection of the charge transistor 208 and the output transistor 204 in the transient condition (e.g. load transient) to speed up the response of local feedback loop path, and combines the charge transistor 208 and the output transistor 204 in the static condition (e.g. continuous power on) to achieve stable feedback loop.

Figure 5:
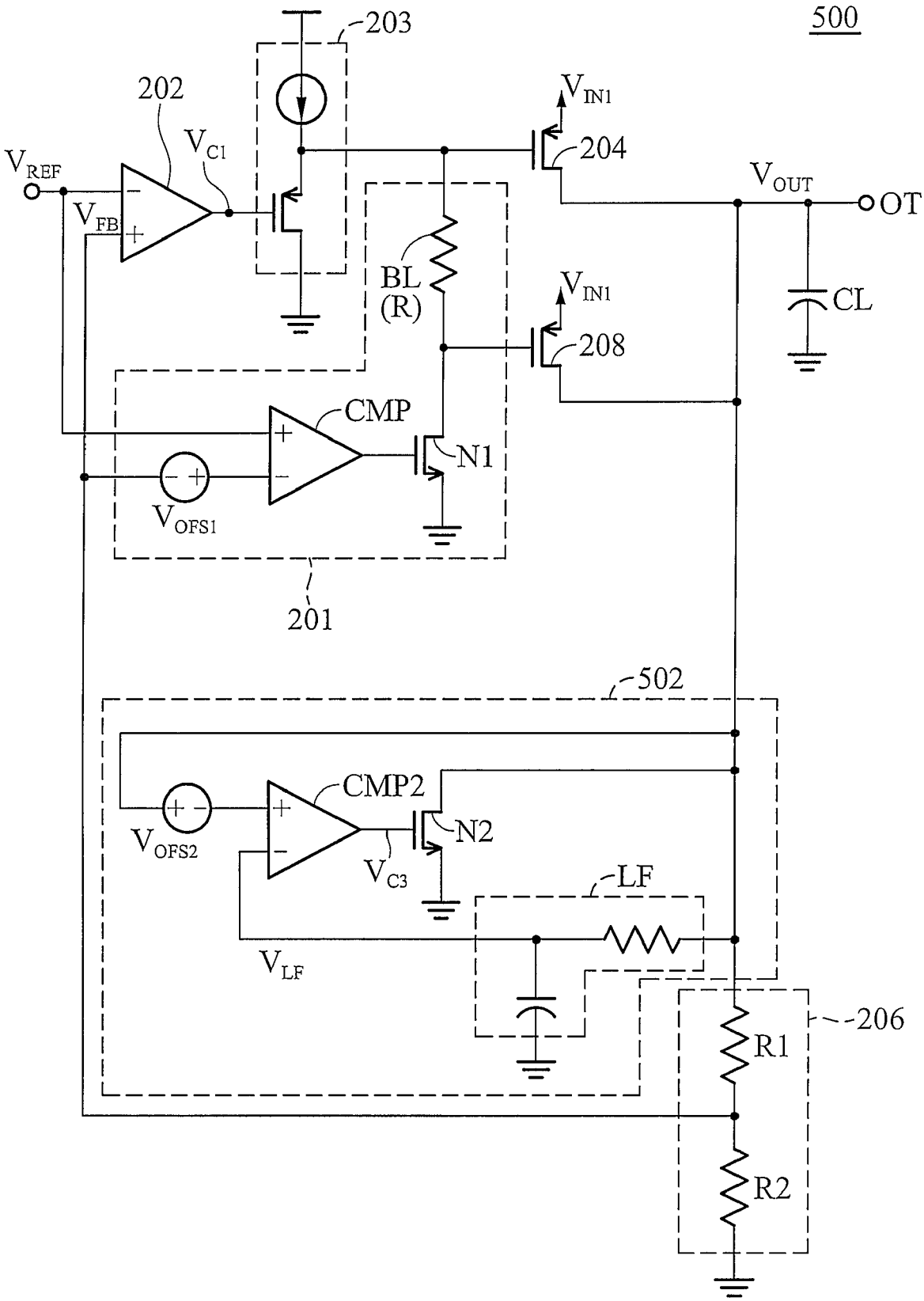
FIG. 5 shows a voltage regulator according to another embodiment of the invention.

FIG. 5 shows a voltage regulator 500 according to another embodiment of the invention, differing from the voltage regulator 200 of FIG. 2 in that it further comprises an overvoltage detector 502.

The overvoltage detector 502 comprises a low-pass filter LF, an overvoltage comparator CMP2 and a discharge transistor N2. The low-pass filter LF has an input coupled to the output voltage ($V_{OUT}$) of the voltage regulator 500 and producing a filtered feedback signal $V_{LF}$. For example, the low-pass filter may be implemented by a resistor and capacitor in FIG. 5. The overvoltage comparator CMP2 has a first input (+) coupled to the output voltage ($V_{OUT}$) of the voltage regulator 500 and a second input (−) coupled to the filtered signal $V_{LF}$. The discharge transistor N2 is a NMOS transistor with its gate coupled to the output of the overvoltage comparator CMP2. It is noted that the overvoltage comparator CMP2 has an input offset voltage indicated as $V_{OFS2}$. The input offset voltage $V_{OFS2}$ can be provided by making the W/L (channel-width-to-channel-length) ratio of the (+) input transistor of the overvoltage comparator CMP2 different with the W/L ratio of the (−) input transistor thereof.

Referring to FIG. 5, when loading changes from heavy to light, the output regulated voltage $V_{OUT}$ suffers an output overvoltage of at least a predetermined magnitude. If the output regulated voltage $V_{OUT}$ rises significantly above the filtered signal $V_{LF}$ by the input offset voltage $V_{OFS2}$, the overvoltage comparator CMP2 outputs a discharge control signal $V_{C3}$ to turn on the NMOS transistor N2, thereby eliminating the overvoltage of the regulated voltage $V_{OUT}$. Therefore, by utilizing the undervoltage detector 201 and the overvoltage detector 502, the voltage regulator 500 can achieve fast response to compensate abrupt transients of from light load to heavy load as well as from heavy load to light load.

Figure 1:
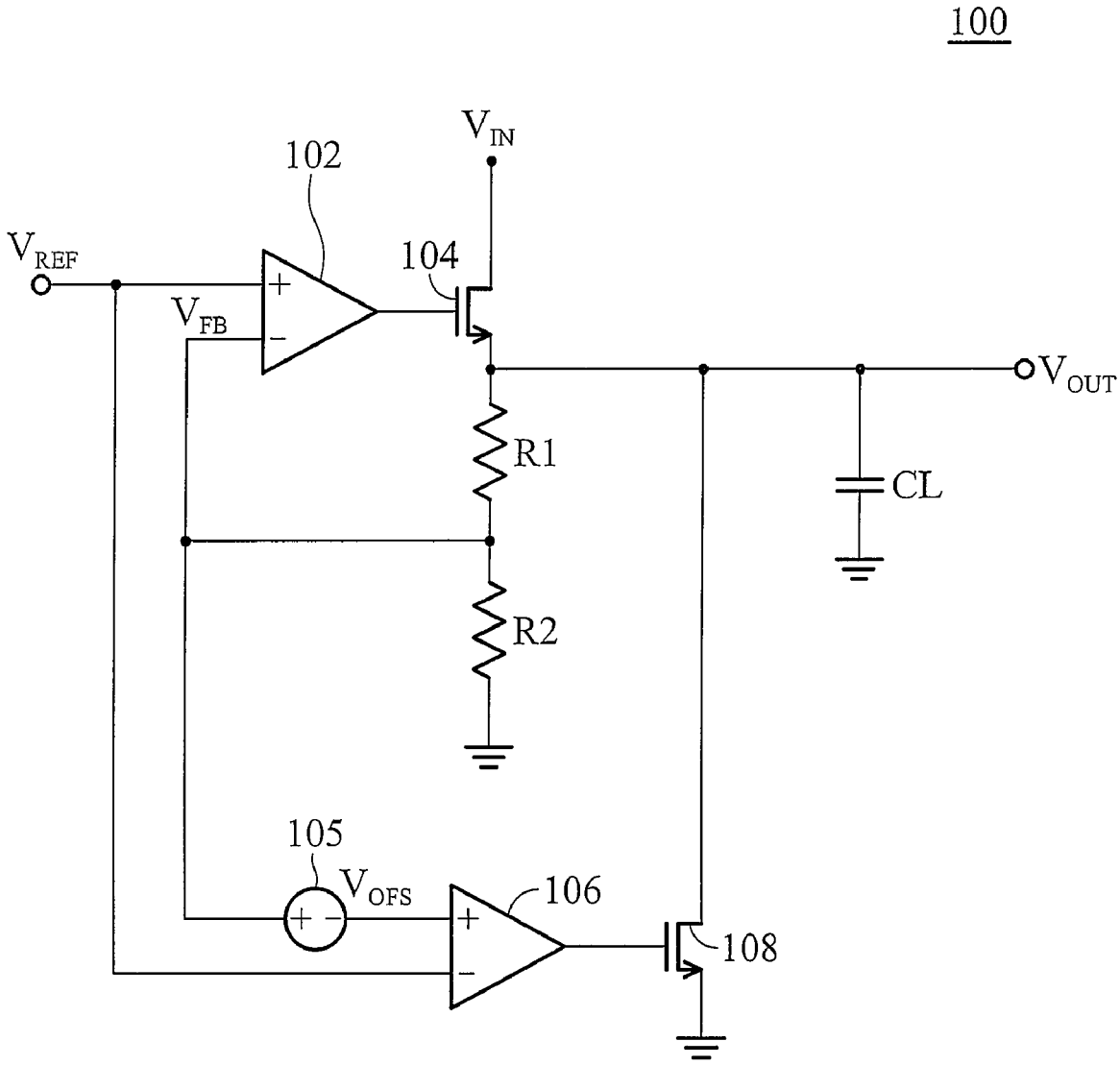
FIG. 1 ( RELATED ART )
FIG. 1 shows a voltage regulator disclosed in U.S. Pat. No. 6,201,375.

As to the prior art illustrated in FIG. 1, the load transient suppression loop is activated when the output voltage $V_{OUT}$ exceeds the reference voltage $V_{REF}$ by a voltage $$V_{OFS} \times \frac{R_1 + R_2}{R_1}.$$

However, in this embodiment, the overvoltage detector 502 starts to compensate (or discharges) the overvoltage when the output regulated voltage $V_{OUT}$ exceeds the filtered signal $V_{LF}$ (i.e., the low-pass filtered output regulated voltage $V_{OUT}$) merely by the input offset voltage $V_{OFS2}$. Therefore, the voltage regulator 500 in FIG. 5 has lower requirement for the variation of comparator offset than that of the prior art voltage regulator in FIG. 1.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A voltage regulator, comprising:

an amplifier having a first input coupled to a first reference voltage, a second input coupled to a feedback signal, and an output producing a control signal;

an output transistor having a control input, a first electrode coupled to a first input voltage, and a second electrode coupled to output a regulated output voltage to an output terminal of the voltage regulator;

a feedback circuit coupled to the output terminal of the voltage regulator to produce the feedback signal;

an undervoltage detector coupled to the first reference voltage and the feedback signal, producing a charge control signal indicating occurrence of an output undervoltage of at least a first predetermined magnitude; and a charge transistor coupled between a second input voltage and the output terminal, having a control input responsive to the charge control signal to charge the output undervoltage; and a blocking device coupled between the control input of the output transistor and the control input of the charge transistor.

2. The voltage regulator as claimed in claim 1, wherein the dimension of the charge transistor is smaller than that of the output transistor.

3. The voltage regulator as claimed in claim 1, wherein the charge transistor and the output transistor are MOS transistors formed on a common active area of a semiconductor substrate, and the output transistor has at least one drain/source region shared with the charge transistor.

4. The voltage regulator as claimed in claim 1, wherein the undervoltage detector comprises an undervoltage comparator having a first input receiving the first reference voltage and a second input coupled to the feedback signal, and an offset voltage is between the first and second inputs of the undervoltage comparator.

5. The voltage regulator as claimed in claim 4, wherein the undervoltage detector comprises an offset voltage source coupled between the feedback signal and the second input of the undervoltage comparator.

6. The voltage regulator as claimed in claim 4, wherein the undervoltage detector comprises a control transistor coupled between a second reference voltage and the control input of the charge transistor, and the control transistor has a control input responsive to the control signal received from the amplifier to drive the charge transistor to charge the output undervoltage.

7. The voltage regulator as claimed in claim 1, wherein the blocking device is a resistor or a transistor, and the transistor has a control input coupled to the output of the amplifier.

8. The voltage regulator as claimed in claim 1, further comprising:

an overvoltage detector comprising:

a low-pass filter coupled to the output terminal of the voltage regulator and producing a filtered signal;

an overvoltage comparator having a first input coupled to the output terminal of the voltage regulator and a second input coupled to the filtered signal, producing a discharge control signal indicating occurrence of an output overvoltage of at least a second predetermined magnitude; and a discharge transistor having a first electrode coupled to the output terminal, a second electrode coupled to a second reference voltage, and a control input responsive to the discharge control signal to discharge the output overvoltage.

9. The voltage regulator as claimed in claim 8, wherein an offset voltage is between the first and second inputs of the overvoltage comparator.

10. The voltage regulator as claimed in claim 1, further comprising:

an inverter having an input coupled between the output of the amplifier and the output transistor.

11. A voltage regulator, comprising:

an amplifier having a first input coupled to a first reference voltage, a second input coupled to a feedback signal, and an output producing a control signal;

an output transistor having a control input, a first electrode coupled to a first input voltage, and a second electrode coupled to output a regulated output voltage to an output terminal of the voltage regulator;

a feedback circuit coupled to the output terminal of the voltage regulator to produce the feedback signal; and an overvoltage detector comprising:

a low-pass filter coupled to the output terminal of the voltage regulator and producing a filtered signal;

an overvoltage comparator having a first input coupled to the output terminal of the voltage regulator and a second input coupled to the filtered signal, producing a discharge control signal indicating occurrence of an output overvoltage of at least a predetermined magnitude; and a discharge transistor having a first electrode coupled to the output terminal, a second electrode coupled to a second reference voltage, and a control input responsive to the discharge control signal to discharge the output overvoltage.

12. The voltage regulator as claimed in claim 11, wherein an offset voltage is between the first and second inputs of the overvoltage comparator.

13. A voltage regulator, comprising:

an amplifier having a first input coupled to a first reference voltage, a second input, and an output;

an inverter having an input coupled to the output of the amplifier, and an output;

an output transistor having a control input coupled to the output of the inverter, a first electrode coupled to a first input voltage, and a second electrode coupled to an output terminal of the voltage regulator;

a feedback circuit having an input coupled to the output terminal of the voltage regulator and an output coupled to the second input of the amplifier;

an undervoltage comparator having a first input coupled to the first reference voltage, a second input coupled to the output of the feedback circuit, and an output;

a control transistor having a first electrode, a second electrode coupled to a second reference voltage, and a control input connected to the output of the undervoltage comparator;

a charge transistor having a first electrode coupled to a second input voltage, a second electrode coupled to the output terminal of the voltage regulator, and a control input coupled to the first electrode of the control transistor; and a blocking device coupled between the control inputs of the output transistor and the charge transistor.

14. The voltage regulator as claimed in claim 13, further comprising:

a low-pass filter having an input coupled to the output terminal of the voltage regulator, and an output;

an overvoltage comparator having an output, a first input coupled to the output terminal of the voltage regulator, and a second input coupled to the output of the low-pass filter; and a discharge transistor having a first electrode coupled to the output terminal of the voltage regulator, a second electrode coupled to the second reference voltage and a control input coupled to the output of the overvoltage comparator.

15. The voltage regulator as claimed in claim 13, wherein the dimension of the charge transistor is smaller than that of the output transistor.

16. The voltage regulator as claimed in claim 13, wherein the blocking device is a resistor or a transistor, and the transistor has a control input coupled to the output of the amplifier.

17. The voltage regulator as claimed in claim 13, wherein the charge transistor and the output transistor are MOS transistors formed on a common active area of a semiconductor substrate, and the output transistor has at least one drain/source region shared with the charge transistor.

18. The voltage regulator as claimed in claim 13, further comprising an offset voltage source coupled between the output of the feedback circuit and the second input of the undervoltage comparator.

* * * * *